United States Patent [19]

Walker

[11] 4,317,114

[45] Feb. 23, 1982

[54] COMPOSITE DISPLAY DEVICE FOR COMBINING IMAGE DATA AND METHOD

[75] Inventor: James T. Walker, Palo Alto, Calif.

[73] Assignee: Cromemco Inc., Mt. View, Calif.

[21] Appl. No.: 148,964

[22] Filed: May 12, 1980

[51] Int. Cl.[3] ..... G09G 1/16

[52] U.S. Cl. ..... 340/721; 340/734; 340/747; 340/799

[58] Field of Search ..... 340/721, 734; 358/183

[56] References Cited

U.S. PATENT DOCUMENTS

| | | | |
|---|---|---|---|
| 3,833,760 | 9/1974 | Tickle | 358/183 |
| 3,944,993 | 3/1976 | Dalke et al. | 340/703 |
| 4,156,237 | 5/1979 | Okada et al. | 358/183 X |
| 4,209,832 | 6/1980 | Gilham et al. | 340/721 X |

*Primary Examiner*—David L. Trafton
*Attorney, Agent, or Firm*—Paul Hentzel

[57] ABSTRACT

A set of overlay images are established within a stack of memory maps for superpositioning over a host image on a raster display. The overlay images include legends, grids, cursors, graphs, formats, etc. which are primarily empty background with few actual image pixels. Overlay conflict between corresponding image pixels from different images is resolved by priority logic in accordance with the order of the image planes within the stack. The background pixels maintain a video switch in the host mode for continuing the flow of host data. The absence of background pixels in any plane (that is the presence of overlay image pixels in any plane) keys the video switch to the insert mode for substituting the overlay pixels for corresponding pixels of host data. The resulting composite data stream is decoded and presented to a D/A for display on a CRT. One overlay code is dedicated to background pixels in the overlay memory map, for indicating the absence of overlay pixels to control the status of the video switch. The background code is not decoded and therefore does not pass through the D/As to produce a visible display characteristic. The corresponding code in the host data may therefore represent a visible characteristic unique to the host image, such as keying a window within the host display to incorporate a secondary host image.

37 Claims, 4 Drawing Figures

COMPOSITE DISPLAY DEVICE FOR COMBINING IMAGE DATA AND METHOD

TECHNICAL FIELD

This invention relates to merging images for a raster scan display device, and more particularly keying a subimage into a background image.

BACKGROUND

Heretofore, subfields were merged with the host field by the "key-croma" technique. A frame or window in the background of the host field was maintained an intense blue. The blue channel of the vidicon was monitored for a high voltage produced when the camera beam scanned the blue background area. The high blue voltage activated a video switch which substituted the subfield data for the host field. One difficulty with this prior art technique is that the foreground of the host field was limited to only minor blue coloring. The foreground blue had to be maintained below the level required to activate the video switch.

Further, only one or two subfields may be keyed on the contents of the host field. The shades-of-blue available for differentiating between subfield windows is limited.

SUMMARY

It is therefore an object of this invention to provide a simplified technique and hardware for keying display images.

It is another object of this invention to provide a subimage keying apparatus and method which is independent of the contents of the host field.

It is a further object of this invention to provide image keying apparatus and method for merging a plurality of images in overlay.

It is a further object of this invention to provide apparatus and method for merging overlay images requiring minimum time and software for forming and updating.

It is a further object of this invention to provide an apparatus and method for forming a window within a host image under an overlay.

It is a further object of this invention to provide a method and apparatus in which overlay data contains non-image pixels for keying a window within the host display.

It is a further object of this invention to provide an apparatus and method of employing non-image pixels to control format characteristics of a display.

Briefly these and other objectives of the invention are accomplished by providing a source of subimage data such as a memory map having M codes, M-bg image codes and bg background or non-image codes. The image codes define the pixel characteristics available for display and the background codes define format characteristics such as keying the host image. Host data is provided having H-ex image codes defining the pixel display characteristics of the host image and ex extra codes defining additional format characteristics. The subimage map is systematically accessed to form a subimage data stream of image pixels and background pixels. The subimage stream is syncronized with the host data to provide time registration therebetween. The background pixels are detected and inhibit the combining of the subimage stream with the host data. The absence of background pixels causes the image pixels to combine with the host data to form a composite display image.

BRIEF DESCRIPTION OF THE DRAWING

Further objects and advantages of the present merging technique, and the operation of the image stack, will become apparent from the following detailed description taken in conjunction with the accompanying drawing in which.

DETAILED DESCRIPTION

Figure 1:
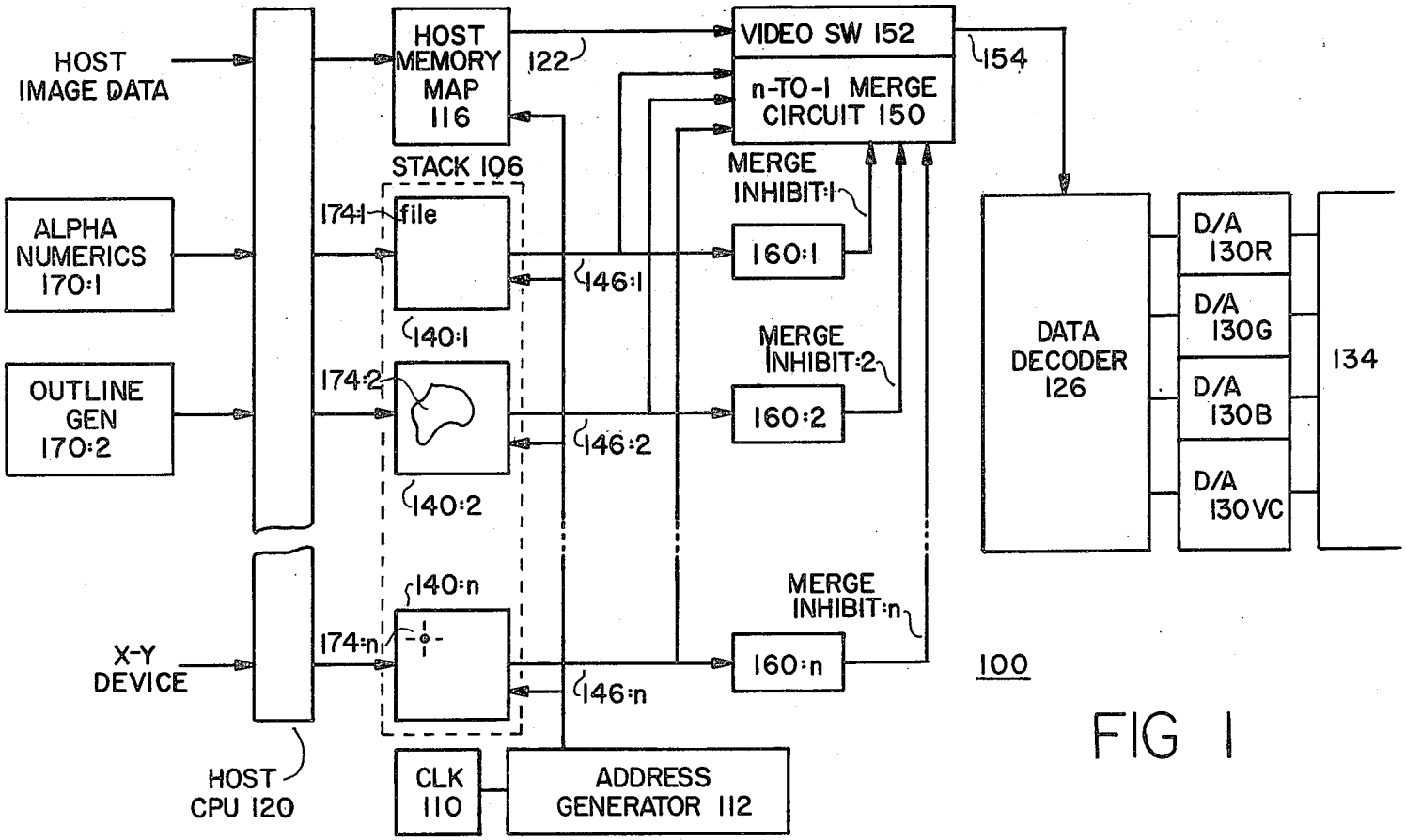
FIG. 1 is a block diagram of a digital imaging system for merging "n" overlay images with a host image.

Composite raster display system 100 (see FIG. 1) is formed by a host channel which provides a stream of pixels for the host image, and a plurality of overlay channels (l through n) within image stack 106 which provide a stream of pixels for each overlay image (l through n). Pixel clock 110 systematically increments memory address generator 112 to provide a train of row and pixel addresses for reading host memory map 116. In the embodiment of FIG. 1, host image data is continuously supplied and processed through host CPU 120 to form a real time display of the host subject matter. The stream of host image pixels 122 from host memory map 116 passes through decoder 126 forming primary color levels for conversion by digital-to-analog devices D/A 130R, D/A 130G, and D/A 130B into analog video signals for display on a suitable device such as CRT display 134. Other visual characteristics in addition to color and intensity may be included in data stream 122 for display on CRT 134. For example "pixel blinking" and "inverted video" may be controlled by host data 122 through suitable analog signals provided by visual characteristic D/A 130VC.

The row and pixel addresses from generator 112 also addresses each overlay channel (l through n) for simultaneously processing the overlay image from each of the overlay memory maps 140:1, 140:2, . . . 140:n, in syncronization with host map 116. As each host pixel is addressed, the corresponding pixel in each overlay image is also addressed in complete syncronization therewith. Overlay data streams 146:1, 146:2, . . . 146:n, are combined with host data stream 122 by n-to-1 merge circuit 150 to form a single composite data stream 154.

Each overlay image occupies only a small portion of the associated memory map 140. The major portion of each map 140 contains pixels of background data. The predetermined code (or codes) assigned to background data is detected by background detectors 160:1, 160:2, . . . 160:n for controlling the priority logic in merge circuit 150. When only background pixels are present in all of the overlay image streams 146, MERGE INHIBIT from detectors 160 prevents merge circuit 150 from keying video switch 152. As a result, overlay data 146 is not merged into the host channel and only host data is displayed. MERGE INHIBIT is normally present and maintains the display of host data 122 on display 134. When overlay image pixels appear in any one or more of overlay data streams 146, the associated background detector 160 removes MERGE INHIBIT from merge circuit 150 permitting the overlay pixel to replace the corresponding host pixel in composite data stream 154. Merge circuit 150 sorts out display conflicts when overlay data stream 146 contains a plurality of coincident overlay image pixels. Each channel of stack 106 is assigned an image plane priority. During an overlay conflict, only pixel data from the topmost image plane is merged into composite data stream 154.

OVERLAY IMAGES

Alpha numeric information such as the name or file number 174:1 of the host subject matter from data source 170:1, may be displayed in overlay as part of the composite image. The desired alpha numeric data is written into map 140:1, and read during each host frame as overlay data stream 146:1. The background data within memory map 140:1 maintains MERGE INHIBIT:1 until the overlay data appears in data stream 146:1. Overlay data 146:1 removes MERGE INHIBIT, causing the overlay data to merge into composite data stream 154.

Changing data such as outline 174:2 of a particular portion of the host subject matter (based on color or intensity contrast) from outline generator 170:2 may be displayed as part of the composite image. Outline 174:2 is read into memory map 140:2, and is updated each frame by interfacing only with the pixels forming the actual outline. The remainder of map 140:2 contains background code which remains unchanged. Each new frame of outline data may be entered into map 140:2 without disturbing or interfacing with the background portion or the map.

A cursor 174:n may be visibly positioned over a particular feature of the host image by means of a suitable coordinate device such as digitizeer tablet 170:n. Updating the cursor position between host frames requires changing only a few pixels of overlay data.

EXTRA HOST CODE

The "m" bits of each pixel provide 2 to-the-m or M possible data codes from memory maps 140. One or more of these codes (bg) are dedicated as background code to indicate background or non-image areas within maps 140, which control format characteristics of the composite image on CRT 134. The other M-bg codes are available for pixel display characteristics. In the embodiment of FIG. 1, the background code (bg=1) is detected to activate video switch 152 for keying host data 122. The M-1 overlay image codes control color, intensity, etc.

Figure 2:
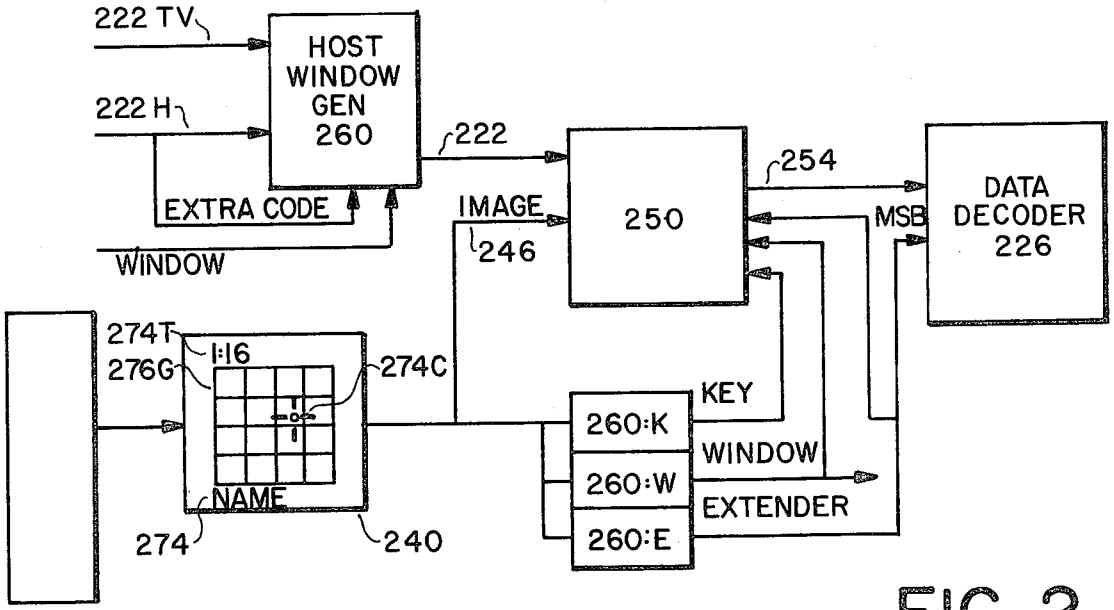
FIG. 2 is a block diagram of a portion of an imaging system showing a host window generator, decoder table extention, and multiple overlay images in a single memory map.

Host data 122 has "h" bits and 2-to-the-h or H possible data codes. In the embodiment of FIG. 2, H-1 of the H codes correspond to the same M-1 pixel characteristics of overlay data 146. The remaining host code is an extra code (ex=1) corresponding to the background code of overlay data 146. The extra host code may be processed to decoder 126 for controlling pixel display characteristics in a manner not available to overlay data 154 which has one less display code.

Alternatively, the extra host code may be employed to control format characteristics such as a host window for displaying a subfield of related data. In the embodiment of FIG. 2, host window generator 260 monitors host image stream 222H for pixels of extra host code, which key window generator 260 causing pixels of TV data 222TV to be substituted for the host data 222H. The substituted TV data 222TV is then merged with overlay data 246 through merge circuit 250. TV data 222TV fills the subfield in the composite display as defined by the extra host code pixels in host memory map 116.

The host window may be positioned under alphanumeric data 246:1 to provide a subfield of a contrasting color behind the letters and numbers. Alternatively, the host window may be employed to frame cursor 274:n in a border of inverted intensity.

MULTIPLE OVERLAYS WITHIN A SINGLE MAP

A set of suitably related overlay images may be sequentially entered into a common memory map 240 (see FIG. 2), bottom image plane first and top image plane last, for merging with host data 222 to form the composite image. In the embodiment of FIG. 2, a grid 274G, a file name 274N, a time period 274T, and a cursor 274C have been entered in overlay into memory map 240 by CPU 220. Cursor 274C will occupy the foremost image plane in the resulting display, and grid 274G will occupy the rearmost image plane.

MULTIPLE BACKGROUND CODES

More than one of the M data codes may be dedicated as background code; that is, bg may be greater than one. The background codes may be employed to control format characteristics in addition to keying host data 222. For instance, a second background code may be detected by detector 260:W for providing WINDOW to window generator 260 creating a window in the display controlled by overlay background code. A third background code may be detected by detector 260:E for extending the dimension of the data table within decoder 226. The output EXTENDER from detector 260:E forms an additional MSB bit to decoder 226 which addresses a second portion of decoder 226, making an entire new set of display characteristics available to the initial h input bits. Thus, alternative display format become available such as color or high resolution black and white.

Figure 3:
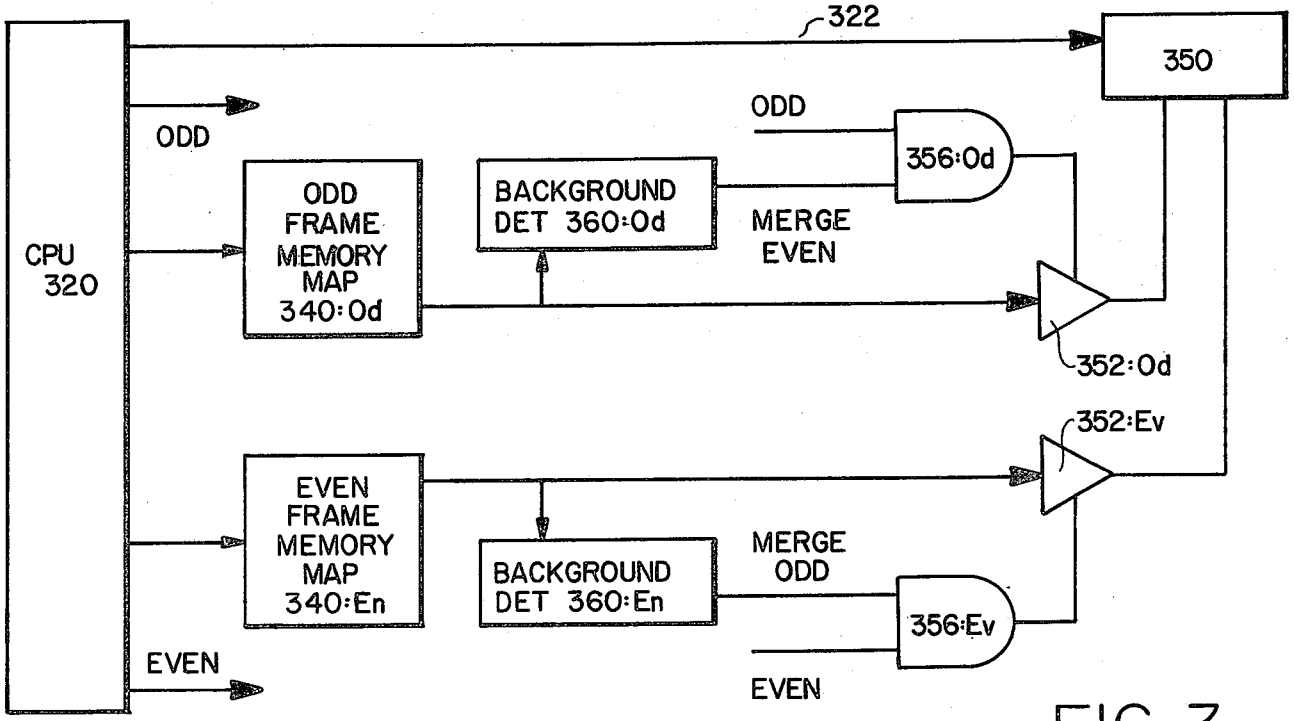
FIG. 3 is a block diagram of a portion of an imaging system showing odd-even overlay images having the same plane priority.

Independent background codes may be employed in the odd frame-even frame configuration of FIG. 3. Odd buffer memory map 340:Od may contain an overlay image and background code independent of even buffer memory map 340:Ev. The odd and even overlays are displayed in the composite display at the same image plane by switches 352:Od and 352:Ev and gates 356:Od and 356:Ev. Signals ODD and EVEN from CPU 320 alternate the odd and even overlays. During the odd frames, the overlay from memory 340:Od is merged with host data stream 322. The background pixels are detected by detector 360:Od for providing MERGE EVEN to even gate 356:Ev causing the even overlay pixels and background pixels to displace the odd background pixels. Similarly, the background pixels in even overlay are detected by detector 360:Ev for merging the odd overlay and background into the background of the even frame. Both odd and even overlays are displayed continuously. Odd-even display alternations occur only for pixels in conflict, which appear to flicker.

SPECIFIC EMBODIMENT

The following specific embodiment is given for illustration only, and is not intended to define the limitations of the invention. Numerous other applications are possible involving different configurations.

Clock 110 may be a 14.318 MHz oscillator for generating pixel clock pulses and vertical and horizontal raster sync pulses for maintaining time registration between the overlay pixels and the host pixels.

Address generator 112 may be a suitable pixel counter (such as disclosed in U.S. Pat. No. 4,121,283 in connection with FIG. 9) for sequencially addressing memory maps 140.

Memory maps 116 and 140 may be a set of dual port dynamic RAMs (MK4116) for receiving 482 lines of 756 pixels each.

Three overlay images are merged with the host image (n=3). The host pixel stream 122 and the overlay pixel streams 1 through n, each have four bits (m=4, M=16).

Decoder 126 may be a 4 to 15 decoder (74S189) for providing M-1 codes.

The predetermined code assigned to the background may be "0000" (or "1") permitting detectors 160 to be merely zero detectors (or one detectors) such as an four input NOR gate (S260). Alternatively, any other code may be assigned as the background code, and be detected by a four bit comparator (74LS85) preset to that code.

Figure 4:
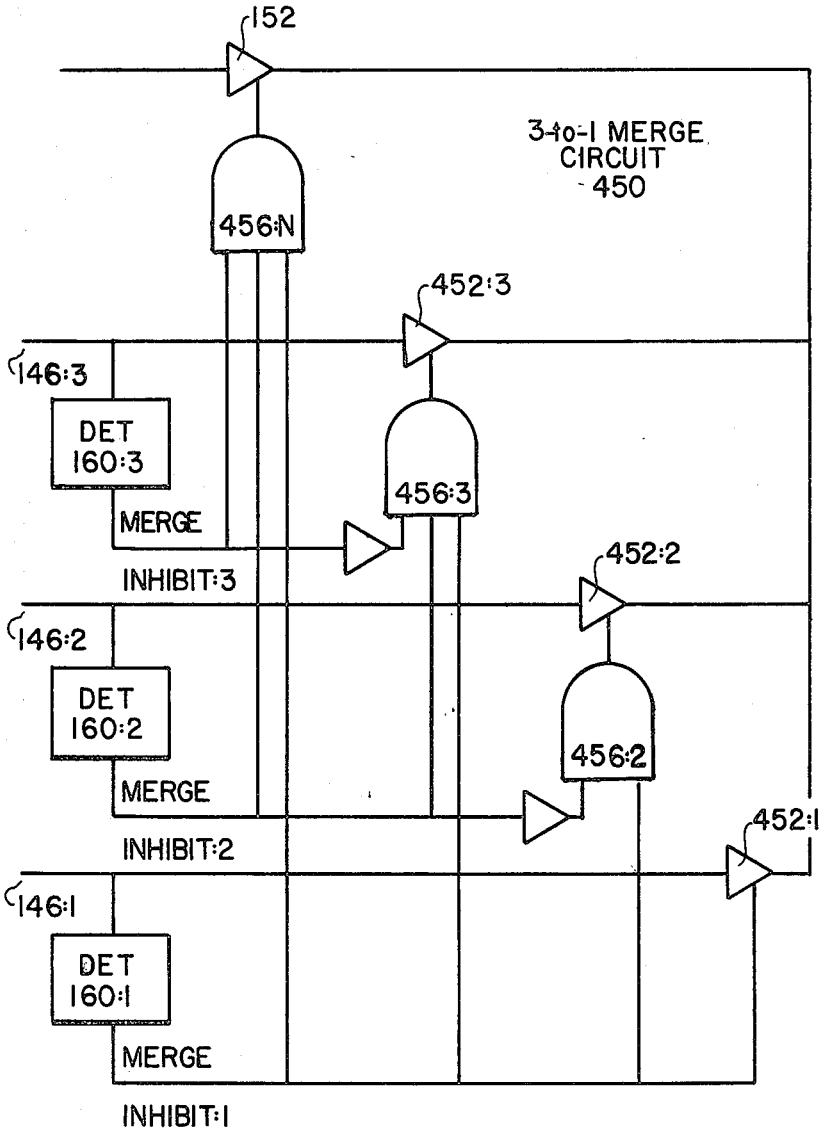
FIG. 4 is a circuit diagram of the n-to-one merge circuit of FIG. 1.

Merge circuit 150 (see FIG. 4) may be a progression of logic circuits formed by tri-state buffers 152 and 452 (74LS244), NAND gates 356 (S10 and S00), and inverters S04 for defining the order of the image planes.

CONCLUSION

The objects of this invention have been accomplished by providing background pixels in an overlay memory map which are available during the host portion of the display for controlling format display characteristics of the host image including keying the host data, and generating windows; and pixel display characteristics such as extending the data decoder to accept a wider range of host data.

It will be apparent to those skilled in the art that changes and modifications may be made in the embodiments shown without departing from the scope of the invention. For example, the invention is not limited to a pixel for pixel substitution by the key switch. The resolution of the overlay image may be greater or less than the resolution of the host image creating an other than one for one exchange.

Therefore, the scope to the invention is to be determined by the terminology of the following claims and the legal equivalent thereof.

I claim as my invention:

1. A method for merging subimage scanline type digital data into a host image to form a composite display on a raster type display device, comprising the steps of:

providing a stream of host image data;

providing a source of the subimage data formed by pixels of subimage data containing at least one image code representing at least one visual display characteristic of the subimage, and formed by pixels of background data containing at least one background code;

systematically addressing the source of subimage data to form a stream of subimage data containing subimage pixels and background pixels;

syncronizing the stream of subimage data with the stream of host image data;

detecting the absence of background pixels in the stream of subimage data;

substituting subimage pixels in the stream of subimage data for the corresponding host image data in the stream of host image data in response to the absence of the background pixels in the stream of subimage data to form a composite display.

2. The method of claim 1, wherein the subimage data has M data codes.

3. The method of claim 2, wherein M-bg of the subimage codes are for subimage pixels to control pixel visual characteristics of the display thereof, and the remaining bg codes are for background pixels to control the format visual characteristics of the display.

4. The method of claim 3, wherein the stream of host image data has H data codes.

5. The method of claim 4, wherein H-ex of the host image codes control the visual characteristics of the display of the host data, and the remaining ex codes control visual characteristics.

6. The method of claim 5, wherein the subimage data has m bits and M=two-to-the-m, and the host data has h bits and H=two-to-the-h.

7. The method of claim 6, wherein m=h and M=H.

8. The method of claim 7, comprising the additional step of generating a window in the host image display for displaying related data in response to at least one of the remaining ex codes of the host data.

9. The method of claim 1, wherein the subimage pixels are syncronized with the host image data by vertical and horizontal raster signals in the host image data.

10. The method of claim 9, wherein the stream of host image data is analog data.

11. The method of claim 9, wherein the stream of host image data are pixels of digital data.

12. The method of claim 11, comprising the additional step of clocking the subimage pixels in syncronization with the host image pixels.

13. The method of claim 12, wherein the clock advances the data pixel by pixel.

14. The method of claim 1, wherein a plurality of subimages are provided from a plurality of subimage sources and merged with the host image.

15. Apparatus for combining at least one pixel type secondary image with a primary data stream for display on a raster type display device, comprising:

memory means for receiving the secondary image pixels representing at least one secondary image and storing the secondary image pixels against background pixels;

accessing means for generating at least one secondary image stream from the memory means, which stream is formed by secondary image pixels and background pixels in time correspondance with the primary data stream;

detector means for detecting the presence and absence of background pixels in the secondary image stream; and switching means for receiving the primary data stream and the secondary image stream, and responsive to the detector means for combining secondary pixels from the secondary image stream with the primary data stream while background pixels are absent in the secondary image stream, and for maintaining the flow of the primary data stream while background pixels are present in the secondary image stream.

16. The apparatus of claim 15, wherein the memory means receives secondary image pixels representing a plurality of n secondary images in plane priority relationship.

17. The apparatus of claim 16, wherein the memory means is a single memory map for sequentially receiving the n secondary images in order of plane priority in which the lowest priority secondary image is entered first and the higher priority secondary images are entered in order of increasing priority.

18. The apparatus of claim 16, wherein:

the memory means is a stack of n memory maps each of which receives secondary image pixels of one of the n secondary images, and each of which provides a secondary image stream in response to the accessing means;

the detector means is responsive to the resulting n secondary image streams for causing the switching means to terminate the secondary image stream containing background pixels, and for causing the switching means to combine one of the secondary image streams with the host data stream.

19. The apparatus of claim 18, further comprising a n-to-one merger means for receiving the n secondary image streams, and responsive to the detector means for continuously determining the highest priority secondary image stream which currently does not contain background pixels.

20. The apparatus of claim 19, wherein:

the merger means is formed by a progressive logic circuit responsive to the detector means for determining the plane priority of the n secondary images; and the switching means is formed by a plurality of independently controlled switches responsive to the logic circuit for terminating the flow of each secondary image stream containing background pixels, and for permitting the substitution of only the highest priority secondary image stream which does not contain background pixels.

21. The apparatus of claim 15, wherein the secondary image stream has M secondary codes.

22. The apparatus of claim 21, wherein M-bg of the secondary codes are secondary image codes defining visual characteristics in the display.

23. The apparatus of claim 22, wherein the bg remaining secondary codes are background codes, at least one of which is detected by the detector means for controlling the switching means.

24. A system for processing host input data and overlay input data to form a composite display, comprising:

input host data means for providing a stream of host image data;

a plurality of overlay memory means each of which receives and stores overlay input data representing an overlay image against background pixels;

addressing means for accessing the plurality of overlay memory means to retrieve an overlay image stream of overlay pixels and background pixels from each memory means in syncronization with the host image stream;

background detector means for monitoring the overlay image stream from each of the plurality of memory means for determining which overlay image streams contain background pixels;

keying means for receiving the host image stream and the plurality of overlay image streams, and responsive to the detector means for keying the overlay pixels of the overlay image stream into the host data stream forming a composite image stream;

digital to analog converter means responsive to the composite image stream from the keying means for providing an analog signal; and display means for generating the composite display in response to the analog signal.

25. The system of claim 24, wherein the host input data means is a memory means for receiving and storing the host input data.

26. The system of claim 25, wherein the accessing means further comprises an address generator for systematically retrieving host pixels from the host memory means and overlay image pixels from the plurality of overlay memory means.

27. The system of claim 26, wherein the address generator further comprises a system clock generator for periodically clocking the memory means to establish syncronization between the host image stream and the overlay image streams.

28. The system of claim 24, wherein the overlay image stream has M overlay codes.

29. The system of claim 28, wherein M-bg of the overlay codes are overlay image codes defining visual characteristics in the overlay portion of the composite display.

30. The system of claim 29, wherein the bg remaining overlay codes are background codes for controlling system format, and at least one of which is detected by the detector means for controlling the keying means.

31. The system of claim 30, further comprising a host window generator responsive to at least one of the B background codes.

32. The system of claim 30, wherein the host image stream has H host codes.

33. The system of claim 32, wherein H-ex of the host codes are host image codes defining visual characteristics in the host portion of the composite display.

34. The system of claim 33, wherein the ex remaining host codes are host extra codes for controlling the system format of the composite display.

35. The system of claim 34, wherein at least one of the ex extra host codes controls a host window within the host portion of the display.

36. The system of claim 34, further comprising a memory table decoder means for receiving the composite image stream and providing decoded data to the digital to analog converter means.

37. The system of claim 36, wherein at least one of the ex extra host codes is applied to the decoder means for further accessing the decoder means and providing further decoded data.

* * * * *